United States Patent [19]

Murakami et al.

[11] Patent Number: 4,745,380

[45] Date of Patent: May 17, 1988

[54] YIG THIN FILM MICROWAVE APPARATUS

[75] Inventors: Yoshikazu Murakami, Kanagawa; Hideo Tanaka, Miyagi; Masami Miyake; Seigo Ito, both of Tokyo; Hitoshi Tamada; Toshiro Yamada, both of Kanagawa, all of Japan

[73] Assignee: Sony Corporation, Tokyo, Japan

[21] Appl. No.: 883,605

[22] Filed: Jul. 9, 1986

[30] Foreign Application Priority Data

Jul. 9, 1985 [JP] Japan ..... 60-150431
Apr. 30, 1986 [JP] Japan ..... 61-100037

[51] Int. Cl.[4] ..... H01P 7/00

[52] U.S. Cl. ..... 333/234; 333/202; 333/219; 333/235

[58] Field of Search ..... 333/202, 204–212, 333/219, 227–235, 245, 246, 248, 238, 24.1, 24.2; 331/96, 107 DP, 107 SL, 117 D; 335/209, 215, 216, 217, 296–298; 352/62.51 R, 62.56, 62.57

[56] References Cited

U.S. PATENT DOCUMENTS 3,713,210 1/1973 Schellenberg ..... 333/24.1
4,614,923 9/1986 Roveda et al. ..... 333/24.2 X

*Primary Examiner*—Marvin L. Nussbaum
*Attorney, Agent, or Firm*—Hill, Van Santen, Steadman & Simpson

[57] ABSTRACT

A YIG film microwave device utilizing the ferrimagnetic resonance of a YIG film, comprising a YIG film microwave element formed by a liquid phase epitaxial growth process and a photolithographic process, and a magnetic circuit including permanent magnets for applying a DC magnetic field to the YIG film microwave element. Some of the $Fe^{3+}$ ions of the YIG film are substituted by nonmagnetic ions to provide the YIG film microwave device with satisfactory temperature characteristics. The YIG film microwave device is capable of operating stably over the wide range of working frequency and that of temperature.

1 Claim, 1 Drawing Sheet

YIG THIN FILM MICROWAVE APPARATUS

BACKGROUND OF THE INVENTION

The present invention relates to a YIG (Yttrium Iron Garnet) film microwave apparatus having means for applying a DC biasing magnetic field to a microwave device employing a ferrimagnetic YIG film resonator.

There has been proposed a microwave apparatus, such as a microwave filter or a microwave oscillator, utilizing the ferrimagnetic resonance of a ferrimagnetic resonator constructed by forming a film of a ferrimagnetic YIG film over a nonmagnetic GGG (Gadolinium Gallium Garnet) substrate by a liquid-phase epitaxial growth process (hereinafter abbreviated to "LPE process") and selectively etching the YIG film by a photolithographic process in a desired shape such as a circular or a rectangular shape.

Such a microwave device is capable of being used with microstrip lines as transmission lines electromagnetically coupled to the YIG thin film for a microwave integrated circuit and facilitates the hybrid connection of one microwave integrated circuit and another microwave integrated circuit. Furthermore, the LPE process and the photolithographic process enable the mass production of the microwave device utilizing the magnetic resonance of a YIG film. The microwave device utilizing the magnetic resonance of a YIG film has many practical advantages over the conventional microwave device employing a YIG sphere.

However, since the ferrimagnetic resonance frequency of the YIG film is greatly dependent on temperature, the microwave apparatus employing a YIG film has inferior temperature characteristics, which is a significant problem in the practical application of the microwave apparatus.

This problem will be described more specifically hereinafter.

Suppose that a YIG film is disposed in a gap of a magnetic circuit so that a DC magnetic field is applied perpendicularly to the film surface thereof and the contribution of an anisotropy field is negligible. Then, the ferrimagnetic resonance frequency of the YIG film can be expressed on the basis of the Kittel's formula:

$$f(T)=\gamma\{Hg(T)-Nz^{Y}\cdot 4\pi Ms^{Y}(T)\}$$

where $\gamma$ is gyromagnetic ratio ($\gamma=2.8$ MHz/Oe), Hg is DC gap magnetic field, $Nz^{Y}$ is the demagnetization factor of the YIG film calculated on the basis of the magnetostatic mode theory, and $4\pi Ms^{Y}$ is the saturation magnetization of the YIG film. Since Hg and $4\pi Ms^{Y}$ are functions of temperature T, resonance frequency f is a function of temperature T. Concretely, in the perpendicular resonance of a YIG disk having an aspect ratio (thickness/diameter) of 0.01, $Nz^{Y}=0.9774$ and if the biasing magnetic field intensity Hg is fixed regardless of temperature, $4\pi Ms^{Y}$ is 1916 G at −20° C. and 1622 G at +60° C. Thus, the deviation of the resonance frequency f in this temperature range is as large as 823 MHz.

Such temperature-dependent deviation of the resonance frequency of a YIG microwave apparatus is avoidable by placing the YIG magnetic resonator in a thermostatic chamber to keep the YIG magnetic resonator at a fixed temperature or by varying the magnetic field intensity by means of an electromagnet according to temperature deviation so that the resonance frequency is maintained at a fixed level. However, these methods require external energy supply and additional control means such as means for controlling electric current and hence a complex constitution.

SUMMARY OF THE INVENTION

Accordingly, it is an object of the present invention to provide a fixed or variable frequency YIG thin film microwave device capable of compensating the deviation of the temperature characteristics without requiring any external circuit, hence any power consumption, and capable of application to wide range of working frequency.

The above and other objects, features and advantages of the present invention will become more apparent from the following description taken in connection with the accompanying drawings.

DESCRIPTION OF THE PREFERRED EMBODIMENT

Figure 1:
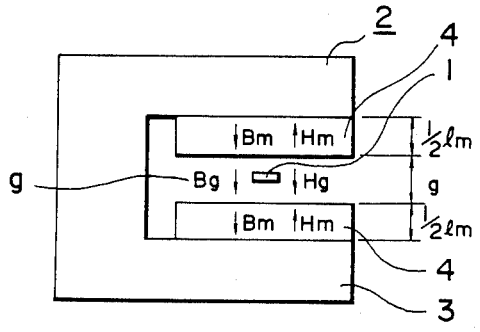
FIG. 1 is a diagrammatic view showing the constitution of a YIG film microwave device is a preferred embodiment.

Referring to FIG. 1, a YIG film microwave device comprises a YIG film microwave element 1 and a magnetic circuit 2 for applying a biasing magnetic field to the YIG film microwave device 1. The magnetic circuit 2 comprises, for example, a U-shaped yoke 3 and a pair of permanent magnets 4 each having a thickness of lm/2 and attached to the inner surfaces of the opposite legs of the yoke 3, respectively, with a gap g having a gap width of lg therebetween. The YIG film microwave device 1 is disposed in the gap g. The remanence Br of the permanent magnets 4 at room temperature is not less than $(fo/\gamma)+Nz^{Y}\cdot 4\pi Mso^{Y}(0)$ and the first order temperature coefficient of remanence Br at room temperature is not less than $$\alpha_1^{Y}(0)\cdot Nz^{Y}\cdot 4\pi Mso^{Y}(0)/\{(fo/\gamma)+Nz^{Y}\cdot 4MsO^{Y}(0)\},$$

where fo is working frequency, $Nz^{Y}$ is the demagnetization factor of the YIG film, $\gamma$ is gyromagnetic ratio, $4\pi Mso^{Y}(0)$ is the saturation magnetization at room temperature when the substitution rate of the nonmagnetic ions of the YIG film for $Fe^{3+}$ is zero, and $\alpha_1^{Y}(0)$ is the first order temperature coefficient of the saturation magnetization of the YIG film when the same substitution rate is zero. The working frequency fo is fixed when the working frequency of the YIG film microwave device is fixed and, when the working frequency of the YIG film microwave device is variable, the working frequency is varied by superposing a variable biasing magnetic field produced by controlling the excitation current of a solenoid, not shown, over the fixed biasing magnetic field and the value of the working frequency fo is a frequency when the exciting current is zero.

According to the present invention, the temperature-dependent variation of the resonance frequency is compensated by using a substituted YIG produced by partially substituting the $Fe^{3+}$ ions of the YIG film by nonmagnetic ions, namely, trivalent nonmagnetic ions, such as $Ga^{3+}$ ions or $Al^{3+}$ ions, or a combination of divalent ions, such as $Ca^{2+}$ ions, and tetravalent ions, such as $Ge^{4+}$, equivalent to trivalent ions.

In the magnetic circuit shown in FIG. 1, suppose that all the magnetic flux passes across the gap g, the magnetic flux density in the gap g is uniform and the magnetic permeability of the yoke is infinity. Then, from Maxwell's relations, $$Bm = Bg \tag{2}$$

$$lmHm = lgHg \tag{3}$$

where Bm and Bg are magnetic flux densities in the permanent magnets 4 and the magnetic gap, respectively, and Hm and Hg are the magnetic fields in the permanent magnets 4 and the magnetic gap g, respectively. The direction of Hm is opposite to those of Hg, Bm and Bg.

Suppose that the permanent magnets 4 do not have a knee point and have a linear demagnetization curve of a fixed recoil permeability $\mu r$. Then, $$Hm = \frac{1}{\mu r}(Br - Bm) = \frac{1}{\mu r}(Br - Hg) \tag{4}$$

Combining Expressions (3) and (4), the magnetic field Hg in the magnetic gap g of the magnetic circuit 2 is expressed as a function of temperature T by $$Hg(T) = \frac{lm Br(T)/\mu r}{(lm/\mu r) + lg} \tag{5}$$

From Expressions (1) and (5), the following equation must hold in order that the resonance frequency is fixed at a fixed value fo regardless of temperature T.

$$\frac{lm Br(T)/\mu r}{(lm/\mu r) + lg} = (fo/\gamma) + Nz^Y \cdot 4\pi Ms^Y(T) \tag{6}$$

On the other hand, the remanence Br of the permanent magnets 4 and the saturation magnetization $4\pi Ms^Y$ of the YIG film microwave element 1 can be sufficiently correctly expressed by taking the first order temperature coefficient $\alpha_1^B$ and the second order temperature coefficient $\alpha_2^B$ into consideration in the temperature range of room temperature plus and minus tens of degrees. Therefore, $$Br(T) = Br^o\{1 + \alpha_1^B(T - To) + \alpha_2^B(T - To)^2\} \tag{7}$$

$$4\pi Ms^Y(T) = 4\pi Mso^Y\{1 + \alpha_1^Y(T - To) + \alpha_2^Y(T - To)^2\} \tag{8}$$

Substituting Expressions (7) and (8) into Expression (6) and supposing that the terms of zero, first and second order with respect to temperature T on both sides are equal to each other, $$Br^o = \left(1 + \frac{lg\mu r}{lm}\right)\left(\frac{fo}{\gamma} + Nz^Y \cdot 4\pi Mso^Y\right) \tag{9}$$

$$\alpha_1^B = \frac{Nz^Y \cdot 4\pi Mso^Y}{(fo/\gamma) + Nz^Y \cdot 4\pi Mso^Y} \cdot \alpha_1^Y \tag{10}$$

$$\alpha_2^B = \frac{Nz^Y \cdot 4\pi Mso^Y}{(fo/\gamma) + Nz^Y \cdot 4\pi Mso^Y} \cdot \alpha_2^Y \tag{11}$$

It is seen from Expression (9) that the permanent magnets 4 need to satisfy an inequality: $Br^0 > (fo/\gamma) + Nz^Y \cdot 4\pi Mso^Y$. It is also seen from Expressions (10) and (11) that the optimum values of the first and second order temperature coefficients of Br are dependent only on the resonance frequency, the demagnetization factor of the YIG film, and the saturation magnetization and temperature coefficient of the YIG film. For example, in the perpendicular resonance of a YIG disk of 0.01 in aspect ratio (thickness/diameter), $Nz^Y = 0.9774$, and, at $To = 20°$ C., $4\pi Mso^Y = 1771.8$ G, $\alpha_1^Y = -2.07 \times 10^{-3}$, and $\alpha_2^Y = -0.996 \times 10^{-6}$. The first and second order temperature coefficients of Br calculated by using those values are tabulated in Table 1. However, practically, it is scarcely possible to prepare a permanent magnet capable of simultaneously satisfying both Expressions (10) and (11). Therefore, only the conditions of Expression (10) for making the gradient of the temperature characteristics curve of the YIG film microwave device zero will be discussed herein. Since the value of $\alpha_1^B$ is inherent in the factor of the permanent magnet employed, and hence a resonance frequency that meets Expression (10) is determined uniquely. For example, resonance frequencies that makes the gradient of the temperature characteristics curve zero for microwave devices having permanent magnets of $Nd_2Fe_{14}B$ having $\alpha_1^B = -1.12 \times 10^{-3}$, permanent magnets of $CeCo_5$ having $\alpha_1^B = -0.9 \times 10^{-3}$ and permanent magnet of $SmCo_5$ having $\alpha_1^B = -0.5 \times 10^{-3}$ are 4.11 GHz, 6.30 GHz and 15.2 GHz, respectively. Thus, when such existing permanent magnets are employed, the working frequency which will realize satisfactory temperature characteristics of the YIG film is restricted. According to the present invention, the substitution ratio $\delta$ of nonmagnetic ions for substituting the $Fe^{3+}$ ions of the YIG film is controlled to achieve satisfactory temperature characteristics of the YIG film microwave device employing the existing permanent magnets for wide range of the working frequency.

TABLE I

| fo(GHz) | Calculated temperature coefficients $\alpha_1^B$ and $\alpha_2^B$ for frequencies $\alpha_1^B$ | $\alpha_2^B$ |
|---|---|---|
| 1.0 | $-1.72 \times 10^{-3}$ | $-8.26 \times 10^{-7}$ |
| 2.0 | $-1.47 \times 10^{-3}$ | $-7.05 \times 10^{-7}$ |
| 3.0 | $-1.28 \times 10^{-3}$ | $-6.15 \times 10^{-7}$ |
| 4.0 | $-1.14 \times 10^{-3}$ | $-5.46 \times 10^{-7}$ |
| 5.0 | $-1.02 \times 10^{-3}$ | $-4.90 \times 10^{-7}$ |
| 6.0 | $-9.26 \times 10^{-4}$ | $-4.45 \times 10^{-7}$ |
| 7.0 | $-8.48 \times 10^{-4}$ | $-4.08 \times 10^{-7}$ |
| 8.0 | $-7.82 \times 10^{-4}$ | $-3.76 \times 10^{-7}$ |
| 9.0 | $-7.25 \times 10^{-4}$ | $-3.49 \times 10^{-7}$ |
| 10.0 | $-6.76 \times 10^{-4}$ | $-3.25 \times 10^{-7}$ |
| 11.0 | $-6.34 \times 10^{-4}$ | $-3.05 \times 10^{-7}$ |
| 12.0 | $-5.96 \times 10^{-4}$ | $-2.87 \times 10^{-7}$ |
| 13.0 | $-5.63 \times 10^{-4}$ | $-2.71 \times 10^{-7}$ |
| 14.0 | $-5.33 \times 10^{-4}$ | $-2.56 \times 10^{-7}$ |
| 15.0 | $-5.06 \times 10^{-4}$ | $-2.43 \times 10^{-7}$ |
| 16.0 | $-4.82 \times 10^{-4}$ | $-2.32 \times 10^{-7}$ |
| 17.0 | $-4.60 \times 10^{-4}$ | $-2.21 \times 10^{-7}$ |
| 18.0 | $-4.40 \times 10^{-4}$ | $-2.11 \times 10^{-7}$ |
| 19.0 | $-4.21 \times 10^{-4}$ | $-2.03 \times 10^{-7}$ |
| 20.0 | $-4.04 \times 10^{-4}$ | $-1.94 \times 10^{-7}$ |

Figure 2:
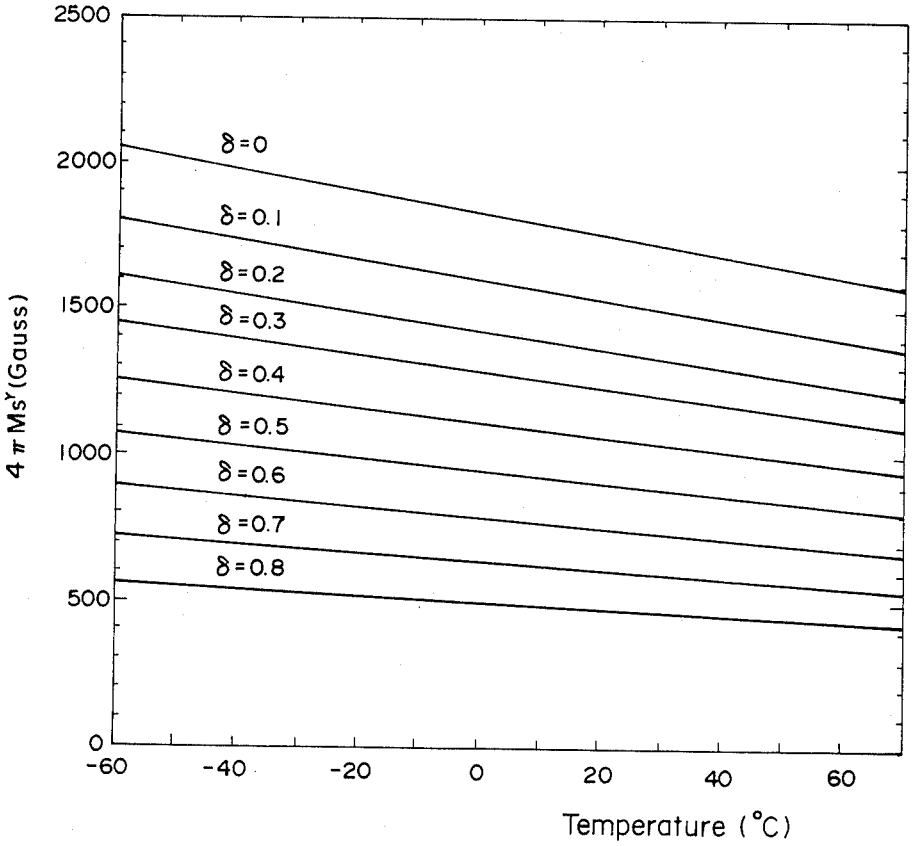
FIG. 2 is a graph showing the deviation of saturation magnetization ($4\pi Ms^{Y}$) of the YIG film with temperature (T) for changes substitution ratios ($\delta$).

The deviation of the saturation magnetization of the YIG film resulting from the substitution of $Fe^{3+}$ ions of the YIG film by nonmagnetic ions will be described hereinafter. Among five $Fe^{3+}$ ions of a pure single crystal of $Y_3Fe_5O_{12}$, three $Fe^{3+}$ ions are at the tetrahedral site and two $Fe^{3+}$ ions are at the octahedral site. The $Fe^{3+}$ ions at the tetrahedral site and those at the octahedral site are arranged in an antiparallel arrangement due to strong superchange interaction. Accordingly, the magnetic moment of five Bohr magnetons ($5\mu_B$) of one $Fe^{3+}$ ion contributes to the saturation magnetization of the YIG film. Suppose that some of the $Fe^{3+}$ ions of the YIG film were substituted by nonmagnetic $Ga^{3+}$ ions. Since all the $Fe^{3+}$ ions substituted by $Ga^{3+}$ ions are those at the tetrahedral site when substitution rate is not very large, the magnetic moment of one molecule of $Y_3Fe_5O_{12}$ is $5\mu_B\times\{(3-\delta)-2\}=5(1-\delta)\mu_B$, and thereby the saturation magnetization is reduced. The details of the saturation magnetization of Ga-substituted YIG is described in Journal of Applied Physics, Vol. 45, No. 6, pp. 2728 to 2732, June, 1974. The variation of the saturation magnetization of $Y_3Fe_5-\delta Ga\delta O_{12}$ with temperature for Ga-substitution rates was calculated by using Expressions (1) to (4) of the above-mentioned paper. The calculated results are shown in FIG. 2. Saturation magnetization $4\pi Ms^Y$ at 20° C., and the first and second order temperature coefficients $\alpha_1{}^Y$ and $\alpha_2{}^Y$ in the temperature range of −20° C. to +60° C., for Ga-substitution ratio δ are tabulated in Table II. It is seen from Table II that the saturation magnetization of YIG at room temperature decreases uniformly as the substitution rate δ increases, while the first order temperature coefficient $\alpha_1{}^Y$ of saturation magnetization remains practically constant independently of the variation of the substitution rate δ.

TABLE II

| | Saturation magnetization and temperature coefficient for Ga-substitution rate (γ) | | |
|---|---|---|---|
| δ | $4\pi M_s{}^Y$(Gauss) | $\alpha_1{}^Y$ | $\alpha_2{}^Y$ |
| 0 | 1771.8 | $-2.07\times10^{-3}$ | $-9.96\times10^{-7}$ |
| 0.1 | 1590.4 | $-2.12\times10^{-3}$ | $-1.22\times10^{-6}$ |
| 0.2 | 1413.9 | $-2.18\times10^{-3}$ | $-1.50\times10^{-6}$ |
| 0.3 | 1242.8 | $-2.23\times10^{-3}$ | $-1.84\times10^{-6}$ |
| 0.4 | 1077.6 | $-2.28\times10^{-3}$ | $-2.26\times10^{-6}$ |
| 0.5 | 918.9 | $-2.33\times10^{-3}$ | $-2.81\times10^{-6}$ |
| 0.6 | 767.2 | $-2.36\times10^{-3}$ | $-3.53\times10^{-6}$ |
| 0.7 | 623.0 | $-2.37\times10^{-3}$ | $-4.41\times10^{-6}$ |
| 0.8 | 487.0 | $-2.33\times10^{-3}$ | $-5.92\times10^{-6}$ |

On the other hand, conditional Expressions (9) and (10) for the permanent magnet can be rewritten by expressing the saturation magnetization of YIG and the first order temperature coefficient of the satuation magnetization as functions of the substitution rate δ, respectively, $$Br^o = \left(1+\frac{lg\mu r}{lm}\right)\left(\frac{fo}{\gamma}+Nz^Y\cdot 4\pi Mso^Y(\delta)\right) \quad (9')$$

$$\alpha_1{}^B = \frac{Nz^Y\cdot 4\pi Mso^Y(\delta)}{(fo/\gamma)+Nz^Y\cdot 4\pi Mso^Y(\delta)}\cdot\alpha_1{}^Y(\delta) \quad (10')$$

Since $4-Mso^Y(\delta)$ decreases uniformly as the substitution ratio δ increases, therefore, if an inequality $$Br^o > \frac{fo}{\gamma}+Nz^Y\cdot 4\pi Mso^Y(o) \quad (12)$$

is satisfied, a solution of the thickness lm of the permanent magnet meeting Expression (9') independently of substitution ratio δ can be found. In Expression (10'), both $\alpha_1{}^B$ and $\alpha_1{}^Y(\delta)$ are negative values and, as mentioned above, $\alpha_1{}^Y$ remains practically constant regardless of the value of the substitution ratio, while $4\pi Mso^Y(\delta)$ decreases regularly as δ increases. Accordingly, the coefficient for $\alpha_1{}^Y(\delta)$ in equation (10'), $Nz^Y\cdot 4\pi Mso^Y(\delta)/\{(fo/\gamma)+Nz^Y\cdot 4\pi Mso^Y(\delta)\}$ is always positive and decreases regularly as the sustitution ratio δ increases. Accordingly, if the condition $$\alpha_1{}^B > \frac{Nz^Y\cdot 4\pi Mso^Y(o)}{(fo/\gamma)+Nz^Y\cdot 4\pi Mso^Y(o)}\cdot\alpha_1{}^Y(o) \quad (13)$$

is established, Expression (10') can be satisfied by properly determining the sustitution ratio δ. That is, desired temperature characteristics can be obtained by properly regulating the substitution ratio of $Fe^{3+}$ ions by nonmagnetic ions.

Since the analytical determination of the value of δ that satisfies Expression (10') is impossible, the same value is determined through computer simulation. However, supposing that the dependence of $\alpha_1{}^Y(\delta)$ on δ is insignificant and that $4\pi Mso^Y(\delta)$ is approximated by a quadratic equation $$4\pi Mso^Y(\delta)=4\pi Mso^Y(o)(1+\beta_1\delta+\beta_2\delta^2) \quad (14)$$

the approximate optimum value of the sustitution ratio δ can be obtained through calculation by using $$\delta = \frac{-\beta_1+\sqrt{\beta_1{}^2-4\beta_2\left\{1-\frac{(fo/\gamma)}{\{(\alpha_1{}^Y/\alpha_1{}^B)-1\}Nz^Y\cdot 4\pi Mso^Y(o)}\right\}}}{2\beta_2} \quad (15)$$

TABLE III

| | Optimum substitution rate (δ), thickness (lm) of the permanent magnet and frequency variation (Δf) for frequencies | | | |
|---|---|---|---|---|
| f(GHz) | δ | lm(mm) | Δf(MHz) | Temperature characteristics curve |
| | | | $Nd_2Fe_{14}B$ | |
| 1.0 | 0.90 | 0.23 | 9.4 | Upward concave |
| 2.0 | 0.68 | 0.48 | 7.9 | " |
| 3.0 | 0.42 | 0.80 | 3.8 | " |
| 4.0 | 0.05 | 1.34 | 1.9 | Upward convex |
| | | | $CeCo_5$ | |
| 1.0 | 0.98 | 0.34 | 10.2 | Upward concave |
| 2.0 | 0.82 | 0.73 | 12.5 | " |
| 3.0 | 0.67 | 1.23 | 12.3 | " |
| 4.0 | 0.50 | 1.92 | 11.2 | " |
| 5.0 | 0.31 | 3.01 | 10.0 | " |
| 6.0 | 0.08 | 5.01 | 8.5 | " |
| | | | $SmCo_5$ | |
| 3.0 | 0.93 | 0.59 | 11.3 | " |
| 4.0 | 0.86 | 0.83 | 12.2 | " |
| 5.0 | 0.79 | 1.11 | 12.5 | " |
| 6.0 | 0.72 | 1.43 | 12.5 | " |
| 7.0 | 0.66 | 1.80 | 12.3 | " |
| 8.0 | 0.59 | 2.26 | 11.9 | " |
| 9.0 | 0.52 | 2.81 | 11.4 | " |
| 10.0 | 0.44 | 3.51 | 10.8 | " |
| 11.0 | 0.36 | 4.41 | 10.3 | " |
| 12.0 | 0.28 | 5.64 | 9.9 | " |
| 13.0 | 0.20 | 7.40 | 9.4 | " |
| 14.0 | 0.11 | 10.10 | 8.8 | " |
| 15.0 | 0.02 | 14.72 | 7.9 | " |

EXAMPLES

YIG film microwave apparatuses of the constitution of FIG. 1, having a magnetic gap g of 3 mm and employing $Nd_3Fe_{14}B$ permanent magnets, $CeCo_5$ permanent magnets and $SmCo_5$ permanent magnets as the permanent magnets 4, respectively were fabricated. The results of simulation using Expression (15) for various working frequencies f of the YIG film microwave devices are tabulated in Tables IIIA, IIIB and IIIC, in which the values of $\delta$ are optimum substitution rates to make the gradient of the temperature characteristics curves of the YIG film microwave devices zero, the values of lm are the respective necessary total thicknesses of the permanent magnets 4, and the values of $\Delta f$ are frequency deviations in the temperature range of $-20°$ C. to $+60°$ C. estimated by taking the second order temperature coefficient into consideration. As apparent from Tables IIIA, IIIB and IIIC, the regulation of the substitution rate $\delta$ of the $Fe^{3+}$ ions of the YIG film by nonmagnetic ions provides the YIG film microwave apparatus employing existing permanent magnets with satisfactory temperature characteristics over the wide range of working frequency.

Although the invention has been described as applied to a fixed frequency YIG film microwave device, the present invention is also applicable to variable frequency YIG film microwave devices having a coil, not shown, wound on the yoke 3 of the magnetic circuit 2.

As apparent from what has been described hereinbefore, according to the present invention, microwave devices having satisfactory temperature characteristics can be obtained and the utility of the microwave devices is enhanced by the possibility of mass-producing YIG films, which brings about great industrial advantages.

Although the invention has been described in its preferred form with a certain degree of particularity, it is to be understood that many variations and changes are possible in the invention without departing from the scope and spirit thereof.

What is claimed is:

1. YIG thin film microwave apparatus comprising a YIG thin film device utilizing ferrimagnetic resonance effect, a magnetic circuit having a gap of length lg in which said YIG thin film device is located and means for applying a bias magnetic field perpendicular to a film surface of said YIG thin film device, said magnetic circuit including a permanent magnet having a thickness lm, said YIG thin film being formed of a substituted YIG thin film where part of $Fe^{3+}$ ion is substituted by a nonmagnetic metal with an atomic proportion of $\delta$, said permanent magnet satisfying the characteristics $$Br > (fo/\gamma) + Nz^Y 4\pi Mso^Y(0)$$

$$\alpha_1{}^B > \frac{Nz^Y\, 4\pi Mso^Y(0)}{(fo/\gamma) + Nz^Y\, 4\pi Mso^Y(0)} \cdot \alpha_1{}^Y(0)$$

wherein fo is resonance frequency of said YIG thin film device $\gamma$ is gyromagnetic ratio of said YIG thin film $Nz^Y$ is demagnetization factor of said YIG thin film $4\pi Mso^Y(0)$ is saturation magnetization of said YIG thin film when said amount $\delta$ equals to zero at room temperature Br is remanence of said permanent magnet at room temperature $\alpha_1{}^B$ is first order temperature coefficient of the remanent magnet near room temperature $\alpha_1{}^Y(0)$ is first order temperature coefficient of the saturation magnetization of said YIG thin film when said amount $\delta$ equals to zero near room temperature and, said thickness lm and said amount $\delta$ being selected to reduce temperature dependency of the resonance frequency.

* * * * *